US008966929B2

(12) United States Patent
Rafalovich et al.

(10) Patent No.: US 8,966,929 B2
(45) Date of Patent: Mar. 3, 2015

(54) COOLED AIR RECIRCULATION IN A REFRIGERATOR

(75) Inventors: Alexander Pinkus Rafalovich, Louisville, KY (US); Ziqiang Hu, Prospect, KY (US)

(73) Assignee: General Electric Company, Schenectady, NY (US)

( * ) Notice: Subject to any disclaimer, the term of this patent is extended or adjusted under 35 U.S.C. 154(b) by 1251 days.

(21) Appl. No.: 11/780,552

(22) Filed: Jul. 20, 2007

(65) Prior Publication Data

US 2009/0019881 A1 Jan. 22, 2009

(51) Int. Cl.

| | |
|---|---|
| ***F25D 17/04*** | (2006.01) |
| ***F25D 11/02*** | (2006.01) |
| ***F25D 17/06*** | (2006.01) |
| *F25C 5/00* | (2006.01) |

(52) U.S. Cl.

CPC ..... *F25D 17/062* (2013.01); *F25C 5/005* (2013.01); *F25D 2317/061* (2013.01); *F25D 2317/0661* (2013.01); *F25D 2317/0665* (2013.01); *F25D 2400/06* (2013.01)

USPC ..... 62/407; 62/441; 62/444

(58) Field of Classification Search

USPC ..... 62/407, 413, 414, 415, 256, 441, 444; 165/146

See application file for complete search history.

(56) References Cited

U.S. PATENT DOCUMENTS

| | | | | | |
|---|---|---|---|---|---|
| 2,794,325 | A * | 6/1957 | Shearer | 62/253 |
| 4,704,874 | A | 11/1987 | Thompson et al. | |
| 4,976,116 | A * | 12/1990 | Hayama et al. | 62/441 |
| 5,694,788 | A | 12/1997 | Shin | |
| 5,921,104 | A * | 7/1999 | Chang | 62/407 |
| 6,318,099 | B1 | 11/2001 | Hwang | |
| 6,539,729 | B2 | 4/2003 | Tupis et al. | |
| 6,647,734 | B2 | 11/2003 | Cho et al. | |
| 6,655,169 | B2 | 12/2003 | Tupis et al. | |
| 2001/0047660 | A1 * | 12/2001 | Mashburn et al. | 62/256 |
| 2003/0000241 | A1 * | 1/2003 | Holz et al. | 62/440 |
| 2005/0097916 | A1 | 5/2005 | Hu | |
| 2005/0229624 | A1 | 10/2005 | Schmid et al. | |

FOREIGN PATENT DOCUMENTS

| | | | | |
|---|---|---|---|---|
| EP | 1403593 | A2 * | 3/2004 | F24H 1/20 |
| WO | WO 03/071204 | A1 | 8/2003 | |
| WO | WO 2004/005814 | A1 | 1/2004 | |
| WO | WO 2005/003659 | A1 | 1/2005 | |
| WO | WO2006054956 | A1 * | 5/2006 | F25D 17/06 |

* cited by examiner

*Primary Examiner* — Cassey D Bauer
*Assistant Examiner* — Kirstin Oswald
(74) *Attorney, Agent, or Firm* — Global Patent Operation; Douglas D. Zhang

(57) ABSTRACT

A refrigerator includes a first storage compartment defining a first interior volume. A first evaporator is configured to cool air that flows past. A first plenum includes a first air outlet, a second air outlet and a first air inlet disposed between the first and second air outlets. The first air inlet is configured to receive air into the first plenum from the first interior volume. The first plenum is configured to flow the air received in the first air inlet over the first evaporator to cool the air. The first and second air outlets are configured to flow the cool air from the first plenum into the first interior volume.

15 Claims, 6 Drawing Sheets

COOLED AIR RECIRCULATION IN A REFRIGERATOR

BACKGROUND OF THE INVENTION

This invention relates generally to a refrigerator, and more particularly, to evaporators and airflow in a refrigerator.

A known refrigerator typically includes at least one evaporator and one or more plenums to circulate air chilled by an evaporator in a compartment of the refrigerator. The evaporator is connected to a compressor to circulate a cooling medium between a condenser and the evaporator. The refrigerator often contains a freezer compartment, a fresh food compartment or both. The freezer compartment is used to store food and other items at temperatures below zero degrees Celsius while the fresh food compartment is used to store foods and other items at temperatures above zero degrees Celsius.

In one type of known refrigerator, a freezer compartment is located above a fresh food compartment. In this configuration, a single evaporator is used and a baffle is placed in a plenum operatively connecting the freezer compartment and the fresh food compartment of the refrigerator. The single evaporator is used to cool the freezer compartment with chilled air to the desired temperature. The baffle is used to control the flow of chilled air to the fresh food compartment to maintain the desired temperature in that compartment. This may be chilled air directed from the freezer compartment, chilled air directed from the evaporator, or a combination.

Another type of known refrigerator is a so-called side-by-side refrigerator that includes a freezer compartment disposed to the side of a fresh food compartment. FIG. 1 is a front perspective view of such a side-by-side refrigerator 200, which may include a fresh food compartment (shown in FIG. 4 as 201) having an interior volume that is cooled to a temperature greater than a standard freezing point temperature of water (e.g., greater than 0 degrees Celsius). The refrigerator 200 also may include a freezer compartment (shown in FIG. 4 as 203) having an interior volume that is cooled to a temperature equal to or less than the standard freezing point temperature of water. Doors 205 and 208 are used to permit and impede or prevent access to the interior volume of the fresh food and/or freezer compartments, respectively. In this design, often two evaporators, one in each compartment, are used to permit individual control of the temperature in each of the controlled compartments. FIG. 2 is a side cross-sectional view of a chilled air system of a freezer compartment of a refrigerator of FIG. 1. Specifically, as shown in FIG. 2, a freezer compartment 303 of the side-by-side refrigerator includes baskets 320 and shelves 322 for holding food items. Air flow 302 is created by fan 304, which draws air from the bottom of the compartment 303 at 306 and into a plenum 324 running to the upper part of the compartment 303. The air is drawn over or through evaporator 308 chilling and dehumidifying the air. The chilled air is then returned to freezer compartment 303 at outlet 307 where some of the chilled air is diverted over icemaker 312 or ice reservoir 316. The rest of the chilled air is returned directly to the freezer compartment 303. The removal of air from the bottom of freezer compartment 303 at 306 and return of chilled air at the top of freezer compartment 303 at outlet 307 creates a generally circular flow 310 encompassing the entire cavity of the freezer compartment 303. This method decreases the temperature gradient within the freezer compartment 303 by discharging chilled air at the top of the compartment to mix with the warmer air. However, this design has not eliminated temperature gradients because obstructions to the circulation of air in the compartment exist and because this design still allows the settling of air during non-cooling periods. Further, when utilized in the fresh food compartment, insulation is needed around the plenum to prevent condensation buildup due to the temperature differential between the cold air in the plenum prior to discharge and the warmer air at the top of the compartment, which may cause frost buildup around the opening of the plenum.

This design also requires the air to travel most of the height of the compartment within the confines of the plenum as the air flows around, through or over the evaporator. To provide the airflow volume necessary to maintain the chilled temperature in the compartment this design requires considerable system pressure and the evaporator must be doubled over to ensure sufficient channels of flow. This reduces the useful volume of the compartment. Further, a larger fan motor is necessary to maintain the higher system pressure due to the distance traveled by the air in the plenum. Using a larger fan motor creates more noise and is less efficient than using a smaller fan motor.

BRIEF DESCRIPTION OF THE INVENTION

As described herein, embodiments of the invention overcome one or more of the above or other disadvantages known in the art.

In an embodiment of the invention, a refrigerator includes a first storage compartment defining a first interior volume. A first evaporator is configured to cool air that flows past. A first plenum includes a first air outlet, a second air outlet and a first air inlet disposed between the first and second air outlets. The first air inlet is configured to receive air into the first plenum from the first interior volume. The first plenum is configured to flow the air received in the first air inlet over the first evaporator to cool the air. The first and second air outlets are configured to flow the cool air from the first plenum into the first interior volume.

In another embodiment, a refrigerator includes a storage compartment defining an interior volume. A first means is used for cooling air. A means is used for distributing air. The means for distributing air is configured to receive air through an inlet, to flow the air received through the inlet over the means for cooling to cool the air, and to flow the cool air into the interior volume through a first outlet and a second outlet. The inlet is disposed between the first and second outlets.

In another embodiment, a method for cooling an interior volume of a storage compartment of a refrigerator includes receiving air into an inlet of a plenum. The air received through the inlet is cooled. The cool air is delivered into the interior volume through a first outlet and a second outlet of the plenum. The first inlet is disposed between the first and second outlets.

BRIEF DESCRIPTION OF THE SEVERAL VIEWS OF THE DRAWINGS

The following figures illustrate examples of embodiments of the invention. The figures are described in detail below.

DETAILED DESCRIPTION OF THE PREFERRED EMBODIMENTS

Embodiments of the invention are described below, with reference to the figures. Throughout the figures, like reference numbers indicate the same or similar components. References to preferred embodiments are for illustration and understanding, and should not be taken as limiting.

Figure 1:
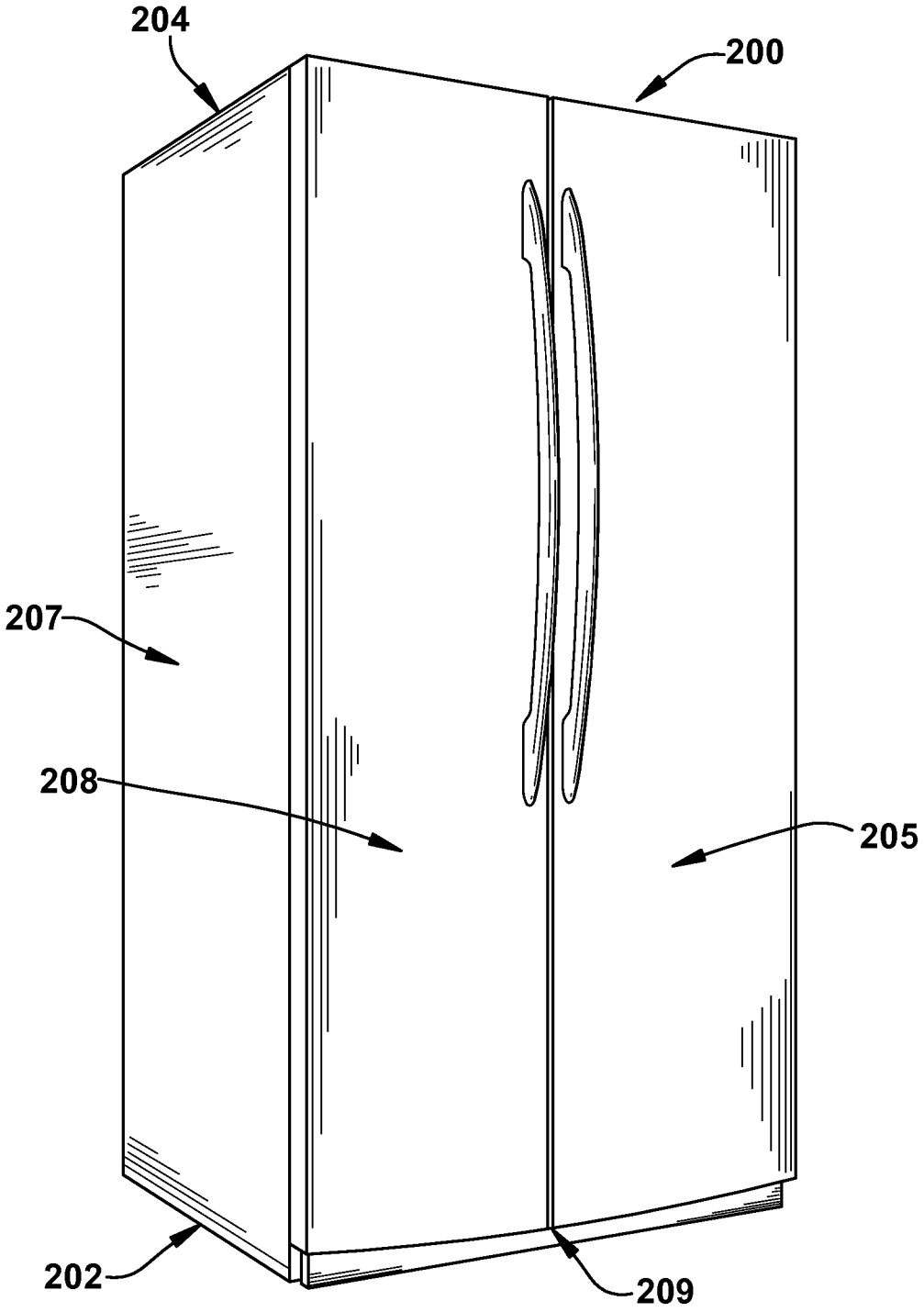
FIG. 1 is a front perspective view of a known side-by-side refrigerator.
Figure 2:
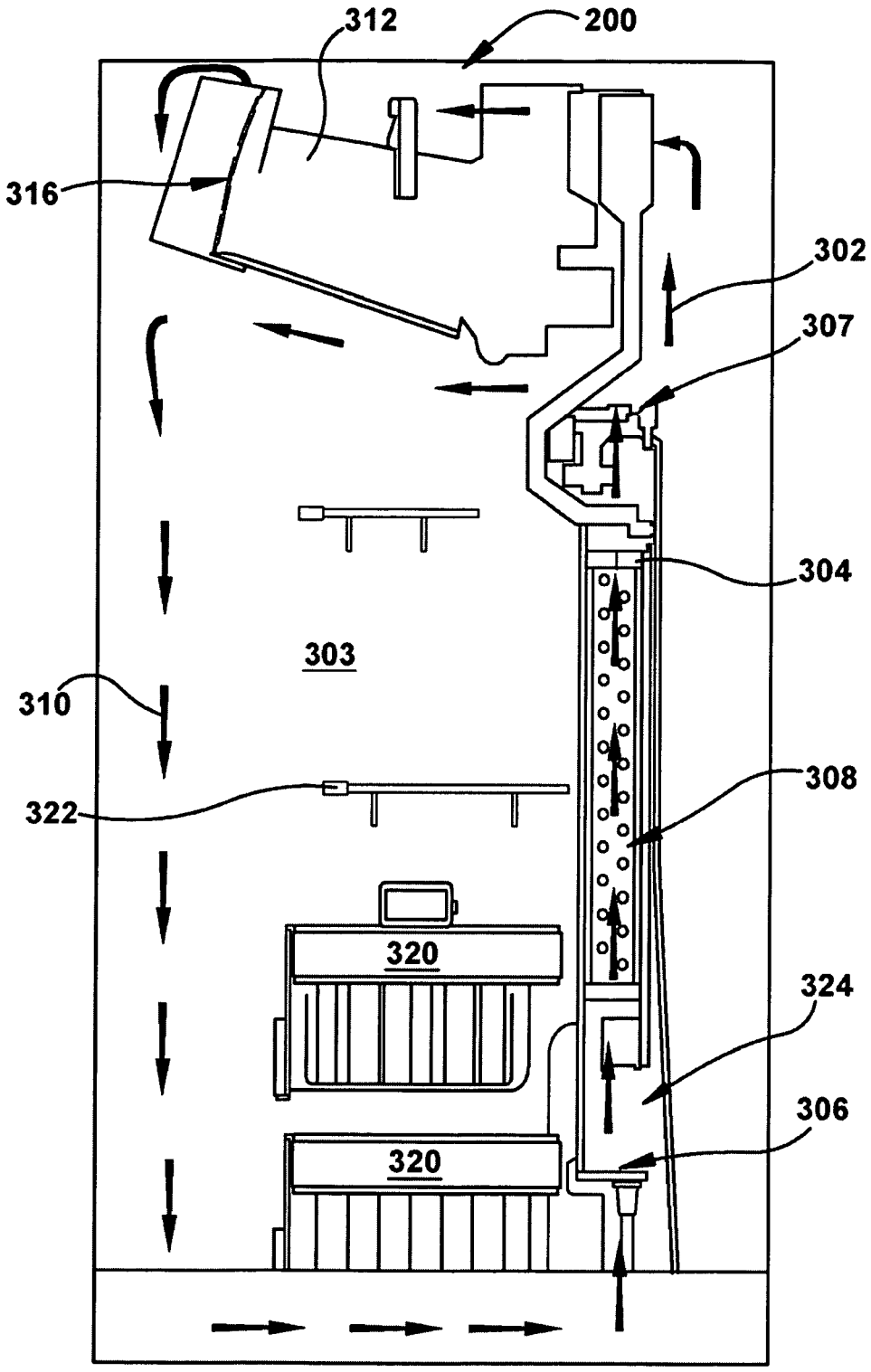
FIG. 2 is a side cross-sectional view of a chilled air system of a freezer compartment of the refrigerator of FIG. 1.

In an embodiment, the fluid circulation system of the invention circulates air in a compartment of a side-by-side refrigerator. It is contemplated that a chilled air circulation system 100 is disposed in a refrigerator 200 containing a vertically configured compartment where the height of the compartment is greater then the width or depth. As discussed above, FIG. 1 is a front perspective view of the refrigerator 200 that includes the fresh food compartment 201 and the freezer compartment 203. The doors 205 and 208 permit and impede or prevent access to the interior volume of the fresh food and/or freezer compartments 201 and 203. At least one chilled air system is used to cool the fresh food and/or freezer compartments 201 and 203 of the refrigerator 200, based on chilled air circulation system 100.

As shown in the figures, the refrigerator 200 is a so-called side-by-side refrigerator where the freezer compartment 203 is disposed to the side of the fresh food compartment 201. Each compartment extends from a bottom 202 to a top 204 and is surrounded by sides 206 and 207. Further, mullion 209 is situated between the freezer compartment 203 and the fresh food compartment 201. It is understood, however, that the air circulation system 100 is not limited to use in any particular refrigerator or one particular compartment, but rather can be disposed in various refrigerators in which the fresh food and freezer compartments 201 and 203 are disposed in a variety of positions relative to one another. It is further understood that the refrigerator in which the air circulation system 100 is disposed is not required to have one or only one of each of the fresh food and freezer compartments 201 and 203, but rather can include none, or one or more of each of the fresh food and freezer compartments 201 and 203. By way of non-limiting examples, the air circulation system 100 can be disposed in a refrigerator that includes one or more fresh food compartments 201 and no freezer compartment 203, or that includes one or more freezer compartments 203 and no fresh food compartment 201. Still further, it is understood that the air circulation system 100 is not limited to use in a refrigerator, but rather can be disposed in various environments where one or more advantages of the air circulation system 100 are provided.

Figure 3:
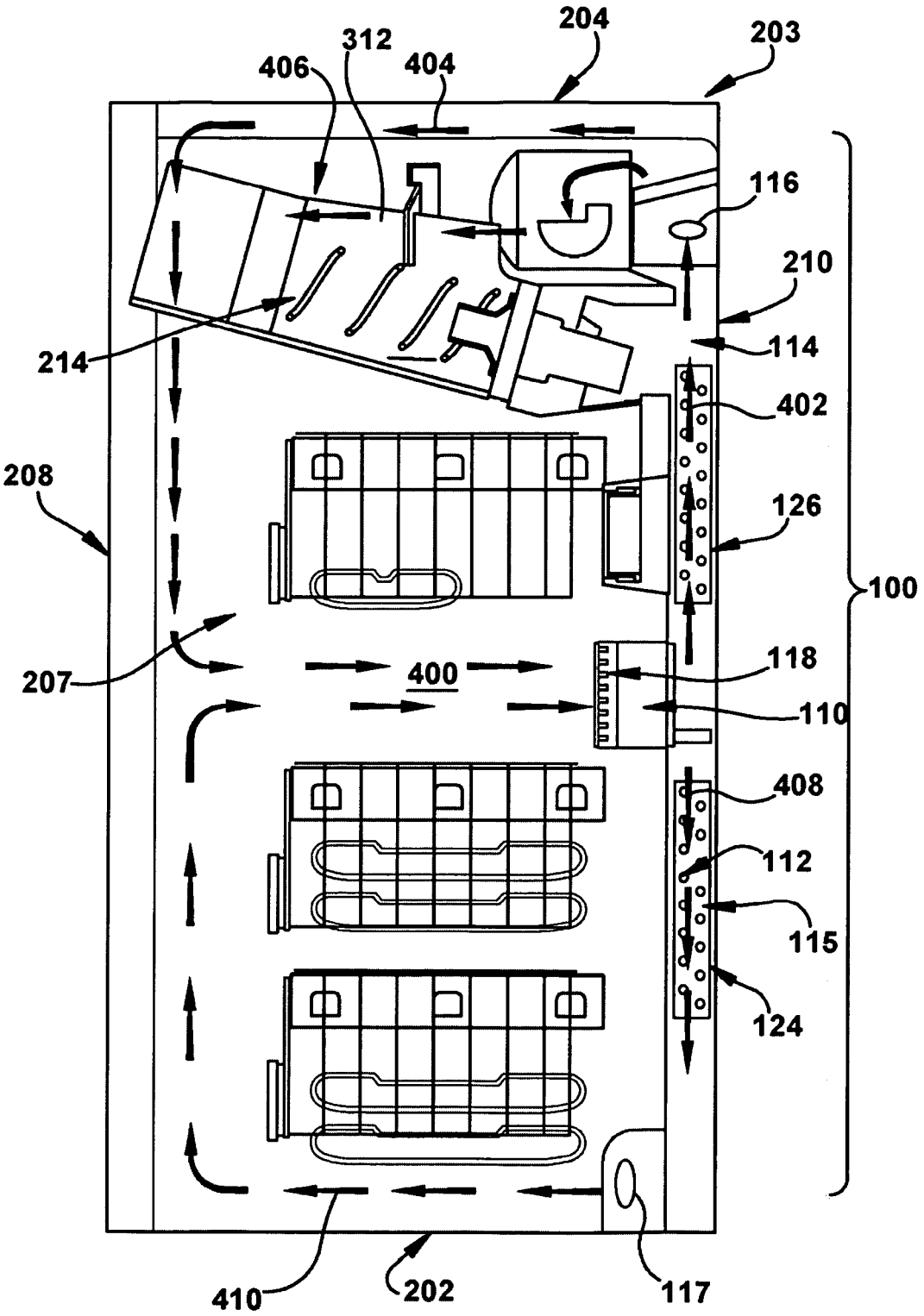
FIG. 3 is a side cross-sectional view of a chilled air system of a freezer compartment of a refrigerator contemplated by the present invention.

FIG. 3 shows one embodiment of the present invention where the freezer compartment 203 is defined by the top 204, the bottom 202, the side wall 207, a back wall 210 and the door 208. Although not shown in the figure, the freezer compartment is also defined by the mullion 209. By this arrangement, the freezer compartment 203 is separated from the fresh food compartment 201. Within or adjacent the back wall 210 is the air circulation system 100. The air circulation system 100 includes a fan 110, an evaporator 112 and a plenum having at least two parts, an upper part 114 and a lower part 115. Air flowing through the upper part 114 and the lower part 115 discharges into the compartment 203 to cause two counter rotating air circulation patterns. Between the upper part 114 and the lower part 115, the fan 110 is located. The evaporator 112 is disposed in the plenum such that a portion of the evaporator 112 is within the plenum upper part 114, and such that another portion of the evaporator 112 is in the plenum lower portion 115. According to an embodiment of the present invention, air 400 is drawn from the freezer compartment 203 into the plenum by the fan 110, which can be located at approximately mid-height of the freezer compartment 203. This height may vary based on desired operational characteristics of the compartment. Where an ice bucket 214 is supplied in the compartment as indicated in FIG. 3 the fan 110 may be located above the mid-height of the compartment at an inlet 118, thereby providing more airflow to the icemaker. Once drawn into the plenum the air 400 moves to both the upper plenum portion 114 as air 402 and the lower plenum portion 115 as air 408. Air 402 in the upper plenum portion 114 moves around, through or over an upper portion of evaporator 112 thereby becoming chilled. Air 402 reenters freezer compartment 203 at outlet 116 as air 404. Air 404 flows along the top 204 and the door 208, and returns as air 400. A portion of the air 404 may be diverted as air 406 to an icemaker 312 to freeze water to form ice. The air 406 then flows through ice bucket 214 before rejoining air 404 at the door 208. Air 408 in the lower plenum portion 115 moves around, through or over a lower portion of the evaporator 112, thereby becoming chilled and reenters the freezer compartment 203 at 117 as air 410. Air 410 flows along the bottom 202 and up along the door 208 before returning to air 400.

Figure 4:
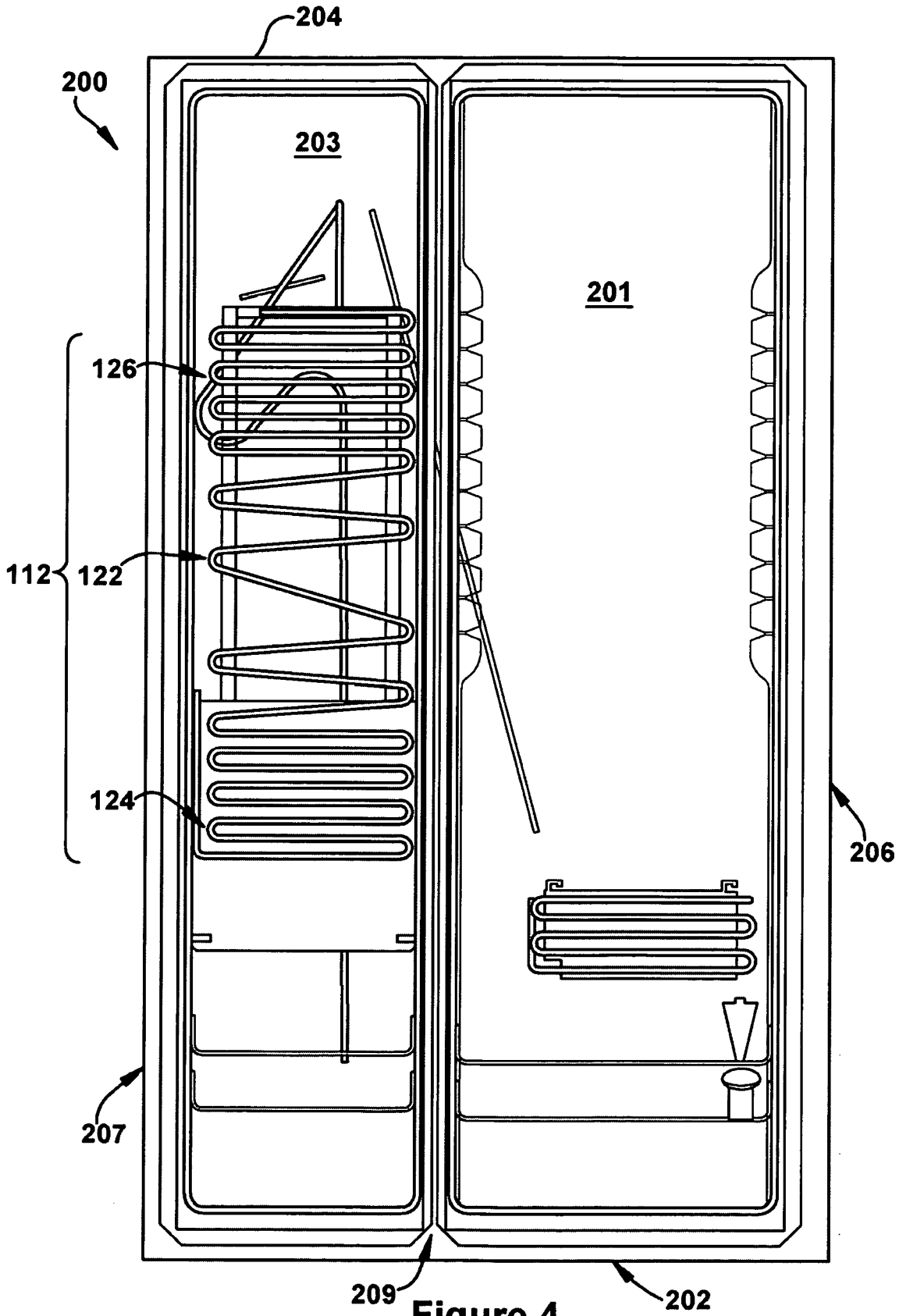
FIG. 4 is a frontal view of one of the embodiments of the evaporators of the refrigerator of FIG. 3.

In one embodiment, the evaporator 112 may contain multiple sections that are joined or are independent. As shown in FIG. 4 the single evaporator 112 may have an upper section 126 and lower section 124 which are denser than a center section 122. The fan 110 is located adjacent to center section 122. The center section 122 is left less dense to accommodate a level of frosting during normal operation without decreasing the flow of air in the air circulation system 100.

Figure 5:
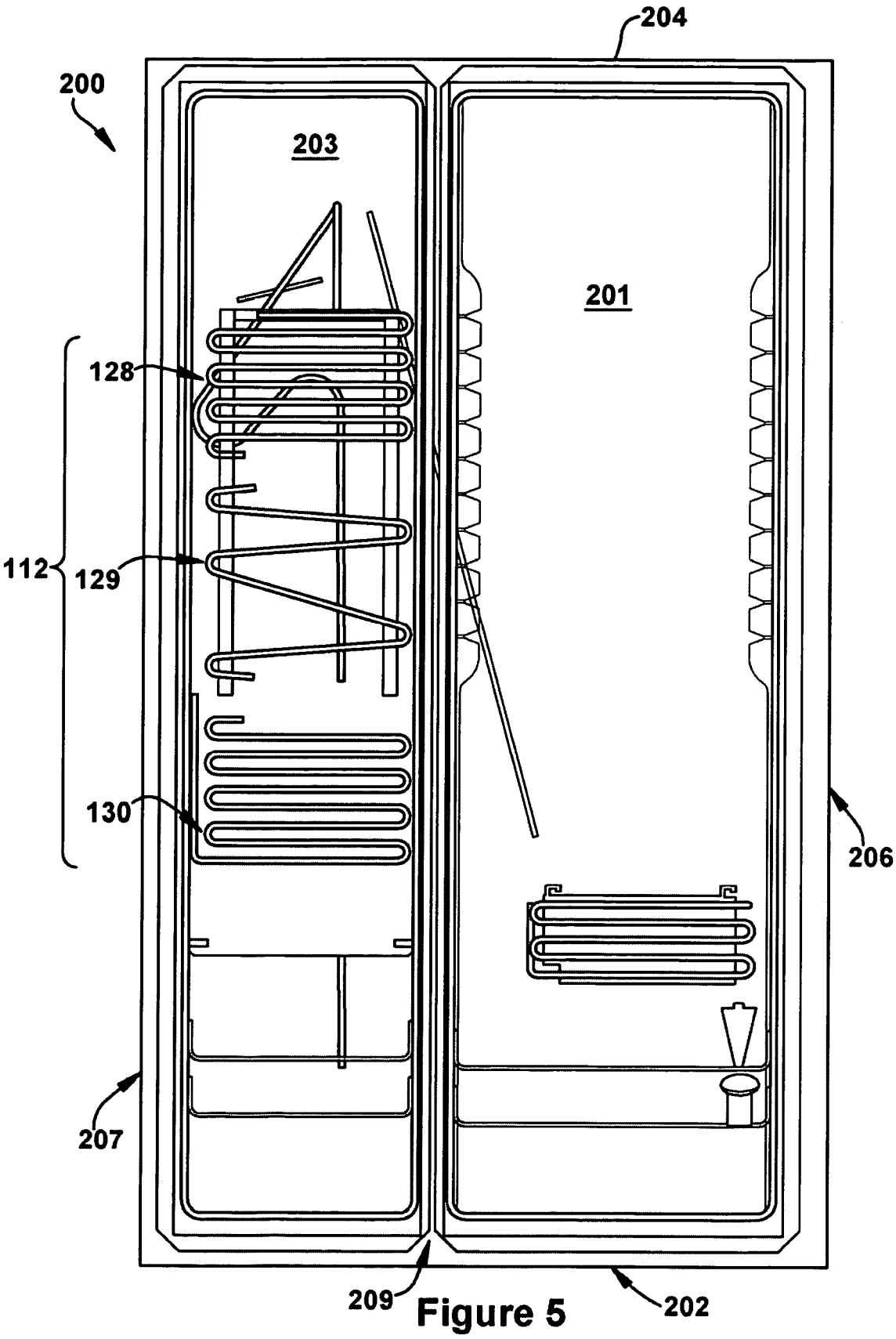
FIG. 5 is a frontal view of another configuration of the evaporators of the refrigerator of FIG. 3.

In another embodiment, the evaporator 112 may consist of several independent sections, as shown in FIG. 5. An upper section 128 and a lower section 130 are each separately controlled by a valve for independent operation and to permit setting a different cooling temperature for each. A third center section 129 of less coil density may be included to dehumidify the air prior to contact with the upper section 128 or the lower section 130 to prevent frosting and a reduction of air flow in plenums 114 and 115, respectively.

Figure 6:
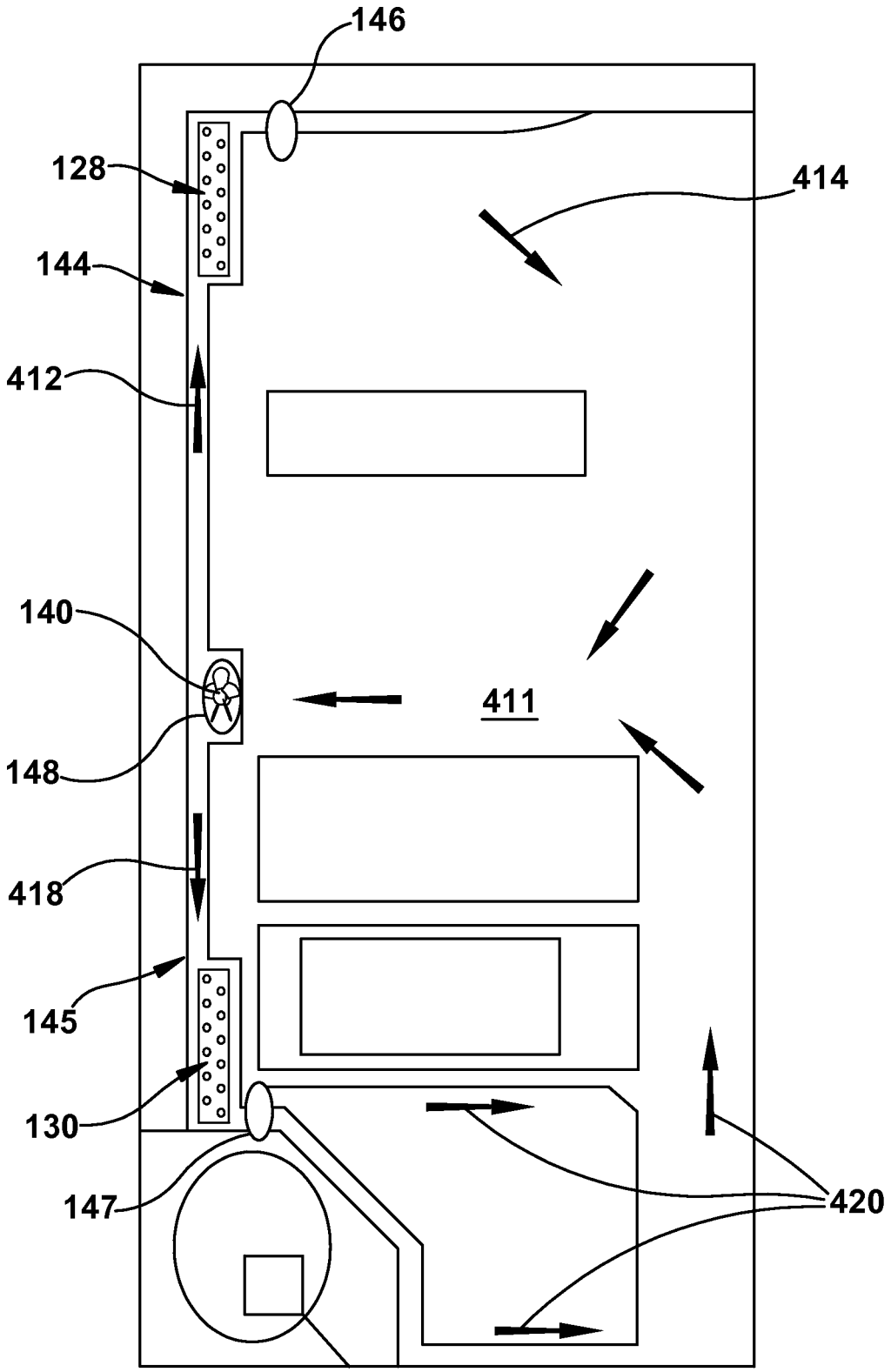
FIG. 6 is a side cross-sectional view depicting the airflow of a fresh food compartment of a refrigerator based on the present invention.

While the invention has been described in relation to a freezing compartment 203 for the side-by-side refrigerator 200, it can be adapted for use in the fresh food compartment 201 of the refrigerator 200, as indicated by FIG. 6. Air 411 is drawn from the fresh food compartment by a fan 140 at inlet 148. A portion of the air then enters a plenum 144 as air 412 while another portion enters a plenum 145 as air 418. The air 412 contacts an evaporator (or an upper part of evaporator) 128, becomes chilled, and is released back into the fresh food compartment 201 through air outlet 146 as chilled air 414. The chilled air 414 moves down the front of the fresh food compartment 201 and joins air 420 to become air 411. The air 418 contacts an evaporator (or a lower part of evaporator) 130, becomes chilled, and is released back into the fresh food compartment 201 through air outlet 147 as air 420. The air 420 moves up the front of the fresh food compartment 201 and joins the air 412 to become the air 411. The cycle is then repeated.

In an embodiment, a refrigerator has a storage compartment with an interior volume. The storage compartment may be a fresh food compartment or a freezer compartment. A desired temperature is maintained by drawing air from the storage compartment through an inlet to a plenum, pipe, duct or other suitable transmission device. The air inlet is configured, in specific embodiments, at the about midpoint of the plenum. At either end of the plenum may be one or more air outlets. Further, an air outlet at one end of the plenum is configured above the air inlet and a second air outlet at the opposite end of the plenum is configured below the air inlet. Movement of the air from the compartment to the plenum is accomplished, in certain embodiments, by use of a fan or similar device positioned at or adjacent the air inlet and/or at or adjacent one or both of the air outlets, creating a pressure within the plenum. Air entering the plenum travels past an evaporator and becomes cooled. The cooled air is then returned to the storage compartment through the air outlets. The air expelled from the upper air outlet causes the air to travel along the top of the compartment and then down the front of the compartment. The air expelled from the lower air outlet travels along the bottom of the compartment and then up the front of the compartment. The streams from the bottom air outlet and the upper air outlet meet in the front and replace air drawn into the air inlet. A series of vented openings, such vents or louvers, may be used at either or both of the upper or lower air outlet to distribute air across the width and height of the compartment. The evaporator may be divided into several separate sections with each section positioned between the air inlet and either the upper air outlet or the lower air outlet. By dividing the evaporator, different levels of cooling may be provided in the upper or lower airflows. This configuration may be beneficial where additional cooling is required in the upper or lower portion of the compartment.

In another embodiment, an interior volume of a storage compartment of a refrigerator is cooled by receiving air into an inlet of a plenum, cooling the air and delivering the cool air back into the interior volume through an upper outlet and a lower outlet of the plenum. The inlet for receiving air into the plenum is disposed between the upper and lower outlet for delivering air back into the compartment. A fan located at the air inlet draws air from the compartment into the plenum. The air becomes cooled by flowing over an evaporator within the plenum. The air expelled from the upper air outlet causes the air to travel along the top of the compartment and then down the front of the compartment. The air expelled from the lower air outlet travels along the bottom of the compartment and then up the front of the compartment. The streams from the bottom air outlet and the upper air outlet meet in the front and replace air drawn into the air inlet. A series of vented openings, such as vents or louvers, may be used at either or both of the upper or lower air outlets to distribute air across the width and/or height of the compartment. The evaporator may be divided into several separate sections with each section positioned between the air inlet and either the upper air outlet or the lower air outlet. By dividing the evaporator, different levels of cooling may be provided in the upper or lower airflows. This configuration may be beneficial where additional cooling is required in the upper or lower portion of the compartment.

This written description uses examples to disclose embodiments of the invention, including the best mode, and to enable a person of ordinary skill in the art to make and use embodiments of the invention. It is understood that the patentable scope of embodiments of the invention is defined by the claims, and can include additional components occurring to those skilled in the art. Such other components and examples are understood to be within the scope of the claims.

The invention claimed is:

1. A refrigerator comprising:

a storage compartment defining therein an interior volume;

a plenum having a first outlet, a second outlet and an inlet disposed between the first outlet and the second outlet, the plenum being in fluid communication with the interior volume through the first outlet, the second outlet and the inlet; and an evaporator disposed in the plenum, the evaporator comprising a plurality of coils, a first section with a first coil density which is disposed between the first outlet and the inlet, a second section with a second coil density which is disposed between the second outlet and the inlet, and a third section with a third coil density which is disposed between the first section and the second section and adjacent to the inlet, wherein each of the first coil density and the second coil density is greater than the third coil density.

2. The refrigerator of claim 1, wherein the storage compartment is either a freezer compartment or a fresh food compartment.

3. The refrigerator of claim 1, wherein the first outlet comprises a vent disposed above the inlet, and the second outlet comprising a vent disposed below the inlet.

4. The refrigerator of claim 1, further comprising a fan disposed adjacent the inlet.

5. The refrigerator of claim 1, wherein the first outlet comprises a vent.

6. The refrigerator of claim 1, wherein the second outlet comprises a vent.

7. The refrigerator of claim 1, wherein the first section, the second section and the third section are independently operable.

8. A refrigerator comprising:

a freezer compartment defining therein an interior volume;

a plenum having a first outlet, a second outlet and an inlet disposed between the first outlet and the second outlet, the plenum being in fluid communication with the interior volume through the first outlet, the second outlet and the inlet; and an evaporator disposed in the plenum, the evaporator comprising a first section disposed between the first outlet and the inlet, and a second section disposed between the second outlet and the inlet, the first section and the second section being configured to provide different levels of cooling to the interior volume via the first outlet and the second outlet, wherein the evaporator is used to cool the freezer compartment only.

9. The refrigerator of claim 8, wherein the first outlet comprises a vented opening disposed above the inlet, and the second outlet comprises a vented opening disposed below the inlet.

10. The refrigerator of claim 8, further comprising a fan disposed adjacent the inlet.

11. The refrigerator of claim 8, wherein the first section and the second section of the evaporator are independently operable.

12. The refrigerator of claim 8, wherein the first section and the second section of the evaporator have different cooling capacities.

13. The refrigerator of claim 8, wherein refrigerator further comprising a fresh food compartment and a separate evaporator for cooling the fresh food compartment.

14. A refrigerator comprising:

a fresh food compartment defining therein an interior volume;

a plenum having a first outlet, a second outlet and an inlet disposed between the first outlet and the second outlet, the plenum being in fluid communication with the interior volume through the first outlet, the second outlet and the inlet; and an evaporator disposed in the plenum, the evaporator comprising a first section disposed between the first outlet and the inlet, and a second section disposed between the second outlet and the inlet, the first section and the second section being configured to provide different levels of cooling to the interior volume via the first outlet and the second outlet, wherein the evaporator is used to cool the fresh food compartment only.

15. The refrigerator of claim 14, wherein the refrigerator further comprises a freezer compartment and a separate evaporator for cooling the freezer compartment.

* * * * *